US008985744B2

(12) United States Patent
Akiyama

(10) Patent No.: US 8,985,744 B2
(45) Date of Patent: Mar. 24, 2015

(54) LIQUID-EJECTION RECORDING HEAD AND METHOD OF MANUFACTURING LIQUID-EJECTION RECORDING HEAD

(75) Inventor: Rumi Akiyama, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 875 days.

(21) Appl. No.: 12/945,630

(22) Filed: Nov. 12, 2010

(65) Prior Publication Data

US 2011/0141198 A1 Jun. 16, 2011

(30) Foreign Application Priority Data

Dec. 14, 2009 (JP) ..... 2009-283450

(51) Int. Cl.
*B41J 2/05* (2006.01)
*B41J 2/14* (2006.01)

(52) U.S. Cl.
CPC ..... *B41J 2/14072* (2013.01)
USPC ..... 347/58; 347/50

(58) Field of Classification Search
USPC ..... 347/20, 50, 57–59, 63, 64, 87
See application file for complete search history.

(56) References Cited

U.S. PATENT DOCUMENTS

| | | | | |
|---|---|---|---|---|
| 6,834,937 | B2 * | 12/2004 | Killmeier et al. | 347/50 |
| 7,118,199 | B2 * | 10/2006 | Mori | 347/58 |
| 7,533,960 | B2 * | 5/2009 | Yasuda et al. | 347/40 |
| 7,712,870 | B2 * | 5/2010 | Shibata et al. | 347/50 |
| 8,083,314 | B2 * | 12/2011 | Goto | 347/29 |
| 8,454,129 | B2 * | 6/2013 | Kanda et al. | 347/50 |
| 2008/0202694 | A1 | 8/2008 | Serbicki et al. | |
| 2008/0316272 | A1 | 12/2008 | Goto | |

FOREIGN PATENT DOCUMENTS

| | | | |
|---|---|---|---|
| CN | 1194058 | A | 9/1998 |
| CN | 101073944 | A | 11/2007 |
| JP | 10-044417 | A | 2/1998 |
| JP | 2006-167972 | A | 6/2006 |
| JP | 2007-055090 | A | 3/2007 |
| JP | 2007-261156 | A | 10/2007 |
| JP | 2007-320067 | A | 12/2007 |

* cited by examiner

*Primary Examiner* — Daniel Petkovsek
(74) *Attorney, Agent, or Firm* — Canon USA, Inc. IP Division

(57) ABSTRACT

A recording head includes a substrate whose first surface has an element that generates energy used for ejecting liquid; a first portion that supports a second surface of the substrate; a wiring member having multiple electrode leads connected to multiple electrode pads provided in the substrate; a second portion that supports the wiring member; and a sealant that seals a section including a connection section between the electrode pads and the electrode leads. A region surrounded by the substrate, the second portion, and the electrode leads is provided with an ascending portion that increases in height in a direction extending from the second surface toward the first surface, the ascending portion increasing in height from a first end to a second end of the region in an arrayed direction of the electrode leads.

5 Claims, 7 Drawing Sheets

LIQUID-EJECTION RECORDING HEAD AND METHOD OF MANUFACTURING LIQUID-EJECTION RECORDING HEAD

BACKGROUND OF THE INVENTION

1. Field of the Invention

The present invention relates to liquid-ejection recording heads that perform recording operation by ejecting liquid toward recording media and to methods of manufacturing the same.

2. Description of the Related Art

In general, liquid-ejection recording heads are fabricated by bonding a recording element substrate, which includes an ink chamber and an energy-generating element for ejecting liquid, and an electric wiring member, which is for electrically connecting the recording element substrate to a liquid-ejection recording device, onto a supporting unit. Multiple electrode leads extending from the electric wiring member are electrically joined to the recording element substrate, and the joint section is sealed by using a sealant composed of a sealing material.

In the configuration of the related art, the upper side and the lower side of the electrode leads are sealed using different kinds of sealants. For the lower side, a first sealant having elasticity when cured and also having relatively high fluidity is applied so that the first sealant can easily flow into narrow gaps at the lower side of the electrode leads. For the upper side, serving as an electrical connection section between the recording element substrate and the electric wiring member, of the electrode leads, a second sealant having strong adhesive force and maintaining a rigid shape when cured is applied. By applying such a sealant, the electrode leads and the electrical connection section can be protected from external force, such as wiping force.

In such a configuration, the recording element substrate and the electric wiring member are bonded to the supporting unit, and the first sealant is poured into a region between the supporting unit and the side surfaces of the recording element substrate. The first sealant covers the lower side of the electrode leads. Subsequently, the second sealant is applied over the first sealant and the upper surface of the electrode leads so as to cover the electrode leads. Japanese Patent Laid-Open No. 2006-167972 discloses a liquid-ejection recording head that uses these two kinds of sealants.

In the method of the related art, the upper and lower surfaces of the electrode leads are covered using two kinds of sealants in this manner. One approach for achieving a simplified process and cost reduction as well as alleviating stress applied on the recording element substrate involves eliminating the sealant (i.e., the first sealant) applied around the recording element substrate. The elimination of the sealant applied around the recording element substrate is expected to achieve the benefit of alleviating the stress applied on the recording element substrate. As mentioned above, the second sealant is to have properties by which the second sealant can maintain its shape and be in a firm state when cured so as to protect the connection section between the electrode leads and the recording element substrate from external force. Due to having extremely low fluidity, if the second sealant is applied from above the upper surface of the electrode leads without applying the first sealant, it would be difficult for the second sealant to flow downward through between the electrode leads and reach the lower side of the electrode leads, resulting in a partially exposed state of the electrode leads. The exposed electrode leads coming into contact with air or ink can sometimes cause an adverse effect.

If a sealant with low viscosity is supposedly used, the sealant may be able to flow to the lower surface of the electrode leads. However, this may not be preferable since the sealant can possibly overflow when the viscosity thereof is lowered during the curing process thereof performed at high temperature, resulting in exposed electrode leads.

SUMMARY OF THE INVENTION

The present invention provides a recording head including a substrate whose first surface is provided with an element that generates energy used for ejecting liquid; a first portion that supports a second surface, serving as an underside of the first surface; a wiring member having a plurality of electrode leads connected to a plurality of electrode pads provided in the substrate; a second portion that supports the wiring member; and a sealant that seals a section including a connection section between the electrode pads and the electrode leads. A region surrounded by the substrate, the second portion, and the electrode leads is provided with an ascending portion that increases in height in a direction extending from the second surface toward the first surface, the ascending portion increasing in height from a first end to a second end of the region in an arrayed direction in which the electrode leads are arrayed.

Further features of the present invention will become apparent from the following description of exemplary embodiments with reference to the attached drawings.

DESCRIPTION OF THE EMBODIMENTS

Figure 7A:
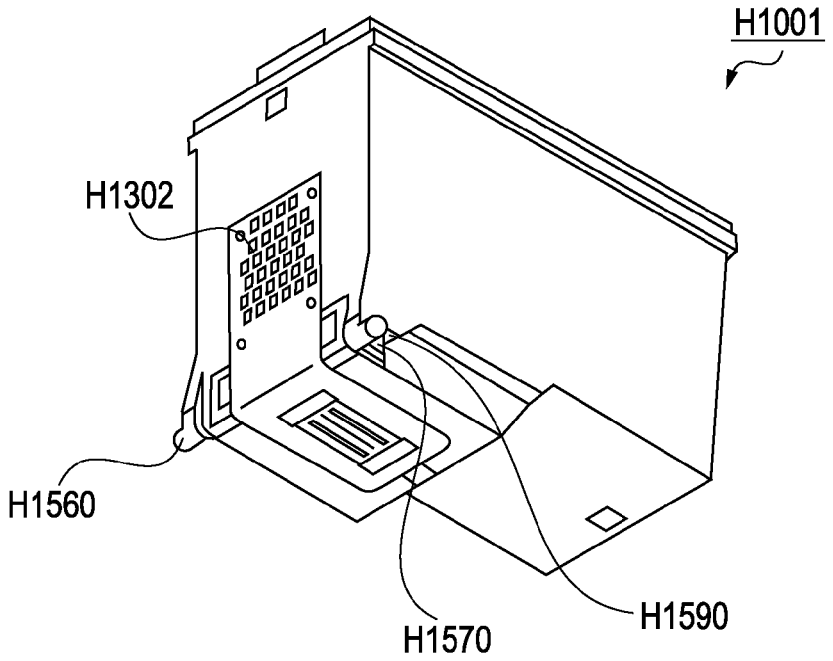
FIGS. 7A and 7B are perspective views of a liquid-ejection recording head according to the present invention.
Figure 7B:
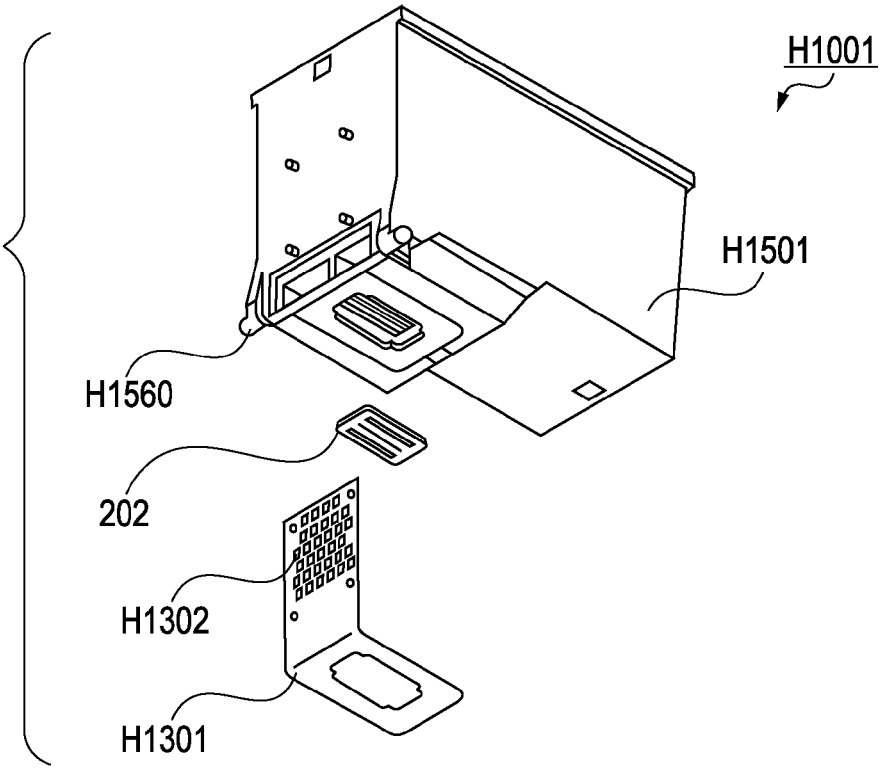

Embodiments of the present invention will now be described with reference to the drawings. FIGS. 7A and 7B are diagrams for explaining a liquid-ejection recording head to which the present invention is suitably applied. Each component will be described below with reference to these drawings.

1. Liquid-Ejection Recording Head

A liquid-ejection recording head H1001 according to an embodiment uses an electrothermal transducer that generates thermal energy as an energy-generating element that generates energy used for ejecting liquid. Moreover, the liquid-ejection recording head H1001 is a so-called side-shooter recording head in which the electrothermal transducer is disposed facing nozzles that eject ink droplets.

The liquid-ejection recording head H1001 is configured to eject liquid, specifically, yellow, cyan, and magenta color inks in this embodiment. As shown in an exploded perspective view in FIG. 7B, the liquid-ejection recording head H1001 includes a recording element substrate 202 having the nozzles and the energy-generating element, an electric wiring member H1301 formed of a flexible film material, and an ink supplying/holding member H1501. Although the configuration for ejecting three kinds of inks is described here, the present invention is not limited to such a configuration so long as the configuration is within the scope of the invention.

2. Loading of Liquid-Ejection Recording Head into Liquid-Ejection Recording Device As shown in FIGS. 7A and 7B, the liquid-ejection recording head H1001 includes a loading guide H1560 for guiding the liquid-ejection recording head H1001 to a predetermined load position of a carriage in a main device body of a liquid-ejection recording device. Moreover, the liquid-ejection recording head H1001 also includes a carriage-scanning-direction stopper H1570 and an ink-ejecting-direction stopper H1590 serving as a positioning unit for positioning the liquid-ejection recording head H1001 to the predetermined load position of the carriage. By positioning the liquid-ejection recording head H1001 using the aforementioned stoppers, external-signal input terminals H1302 on the electric wiring member H1301 are accurately brought into electrical contact with contact pins in an electrical connection section provided within the carriage.

3. Liquid-Ejection Recording Device

Figure 8:
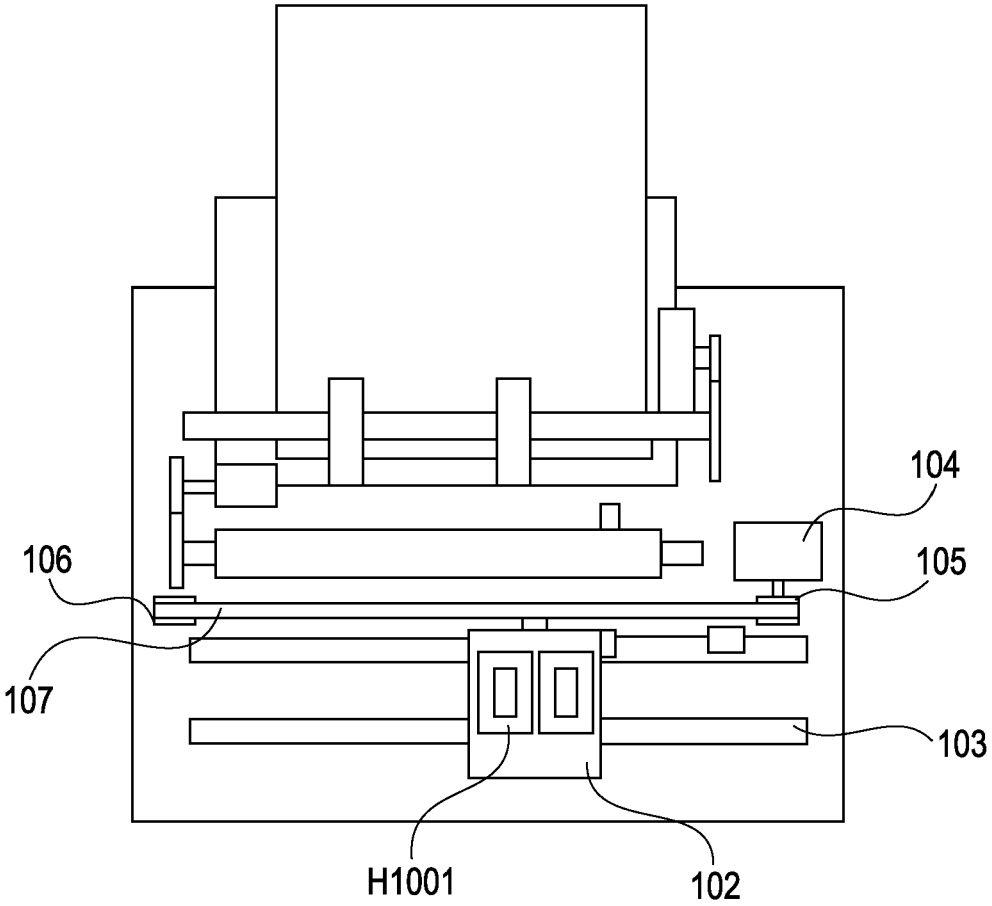
FIG. 8 illustrates a liquid-ejection recording device loaded with the liquid-ejection recording head according to the present invention.

Next, a liquid-ejection recording device that can be loaded with a cartridge-type liquid-ejection recording head as described above will be described. FIG. 8 illustrates an example of the recording device that can be loaded with the liquid-ejection recording head according to the present invention.

The liquid-ejection recording head H1001 in FIGS. 7A and 7B is loaded in a carriage 102 of the recording device in FIG. 8 in a replaceable manner. The carriage 102 is provided with an electrical connection section for transmitting drive signals to ejecting portions via the external-signal input terminals on the liquid-ejection recording head H1001.

The carriage 102 is guidably supported in a reciprocable manner along a guide shaft 103 set in the main device body and extending in the main scanning direction. A main-scanning motor 104 drives the carriage 102 and controls the position and the movement thereof via a drive mechanism including a motor pulley 105, a driven pulley 106, and a timing belt 107. The liquid-ejection recording head H1001 is loaded onto the carriage 102 such that the arrayed direction of the nozzles is orthogonal to the scanning direction of the carriage 102, and performs recording by ejecting ink through these nozzles.

Figure 1A:
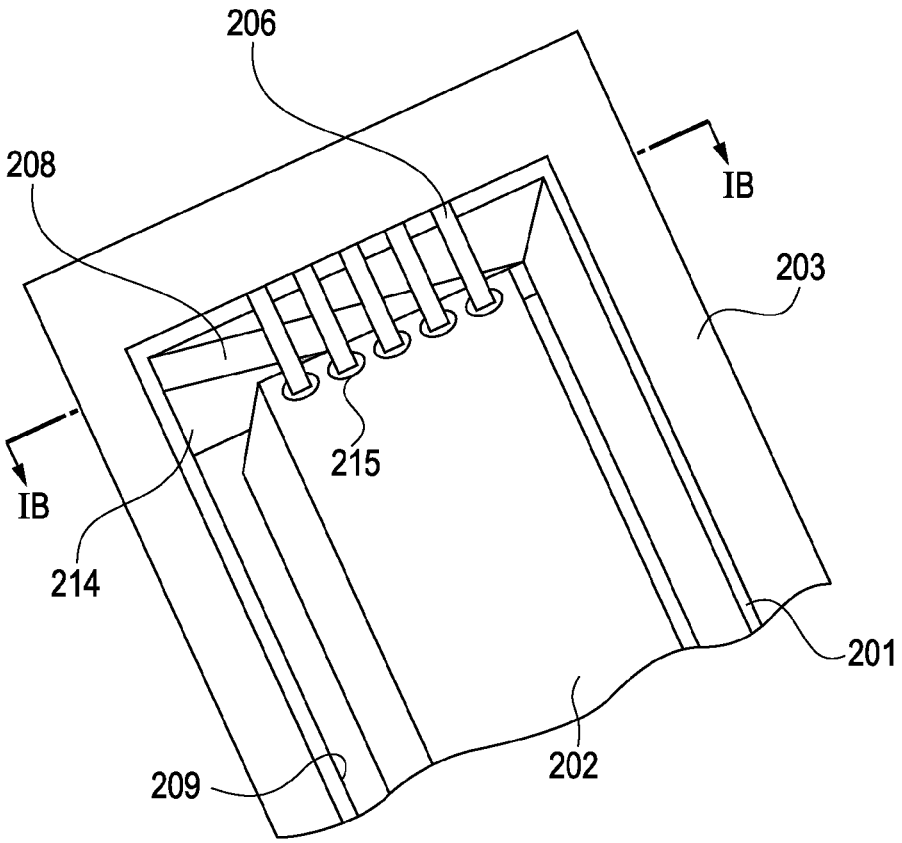
FIGS. 1A and 1B schematically illustrate a liquid-ejection recording head according to a first embodiment.
Figure 1B:
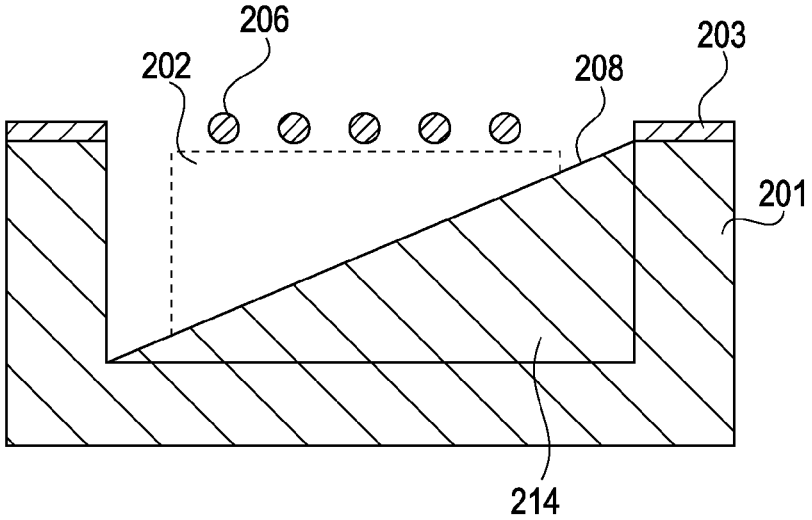

FIGS. 1A and 1B are enlarged views schematically illustrating the recording element substrate 202 and a surrounding area thereof according to a first embodiment. FIG. 1B is a cross-sectional view taken along line IB-IB in FIG. 1A. A supporting unit 201 provided in the ink supplying/holding member H1501 of the liquid-ejection recording head H1001 is provided with a recess 209 for disposing therein the recording element substrate 202. As shown in FIG. 1A, the recording element substrate 202 is supported at the bottom of the recess 209 in the supporting unit 201 (first support portion). An electric wiring member 203 is supported at the top surface of the supporting unit 201 (second support portion). Multiple electrode leads 206 formed in the electric wiring member 203 are electrically connected to multiple electrode pads 215 formed in the recording element substrate 202.

When a surface of the recess 209 that securely holds the recording element substrate 202 is defined as the bottom surface, the bottom surface of the recess 209 below the electrode leads 206 is provided with an inclined portion 214 having an inclined surface 208 that gradually increases in height in an arrayed direction of the electrode leads 206. Specifically, the inclined portion 214 is provided in a region surrounded by the recording element substrate 202, the supporting unit 201, and the multiple electrode leads 206. In this surrounded region, the inclined portion 214 in this embodiment forms the inclined surface 208 whose height from the bottom surface increases from a first end to a second end of the region in the arrayed direction of the electrode leads 206. The lowest point of the inclined surface 208 is located at the first end of the region and is outside the electrode lead 206 located at the end of the electrode lead group in the arrayed direction.

The highest point of the inclined surface 208 is located at the second end of the region. Specifically, the inclined portion 214 is formed such that the distance between the inclined surface 208, serving as an upper surface of the inclined portion 214, and the electrode leads 206 gradually decreases from the first end toward the second end. Since this region is to be sealed using a sealant 211, the highest point of the inclined portion 214 located at the second end of the region is positioned lower than the electrode leads 206.

FIGS. 2A to 2D illustrate a manufacturing process of applying the sealant to an electrical connection section between the recording element substrate 202 and the electric wiring member 203.

Figure 2A:
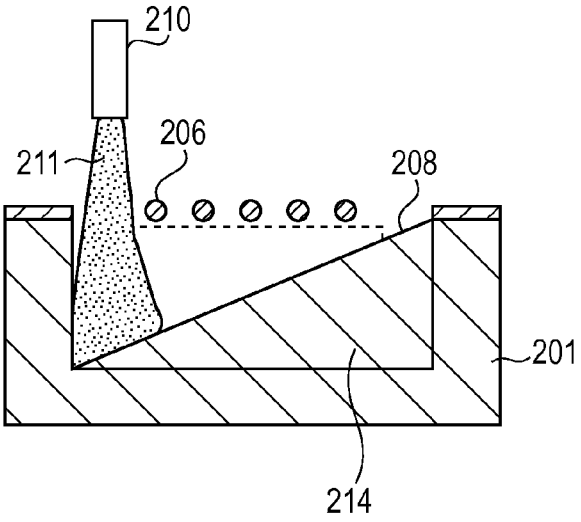
FIGS. 2A to 2C schematically illustrate a sealant application method according to the first embodiment, and FIG. 2D schematically illustrates a sealant application method of a comparative example.

As shown in FIG. 2A, a dispenser needle 210 for applying the sealant is set at a position corresponding to the vicinity of the lowest point of the inclined portion 214. In a state where the needle 210 is held still at this position, the sealant is discharged toward the lowest point of the inclined portion 214 (first application step). In this embodiment, the sealant used here has relatively high viscosity for the purpose of sealability mentioned above. Therefore, the discharged sealant spreads slowly from the discharged position to the surrounding area. Since the aforementioned inclined portion 214 is provided in this embodiment, the distance between the inclined surface 208 and the electrode leads 206 gradually decreases. This means that the inclined portion 214 is formed so that a space (volume) to which the sealant is applied gradually decreases. Therefore, the applied sealant gradually spreads while ascending the inclined surface 208 toward the second end of the aforementioned region without overflowing in the height direction.

Figure 2B:
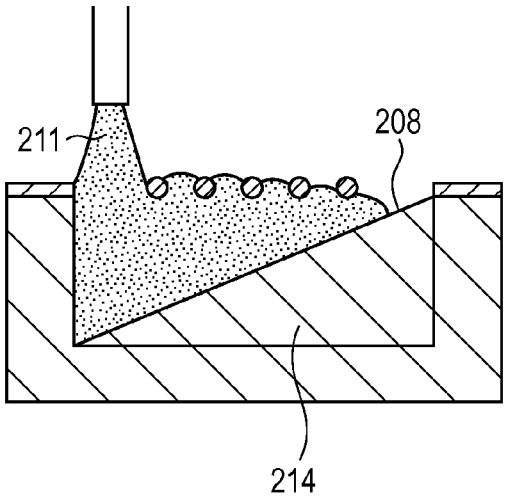

As shown in FIG. 2B, with the needle 210 in the fixed position, the sealant is continuously applied until the sealant reaches the lower surface of the electrode lead 206 located at the second end. Thus, the space up to the lower surface of the electrode leads 206 can be reliably sealed, thereby preventing or reducing formation of unnecessary voids in the seal area.

Figure 2C:
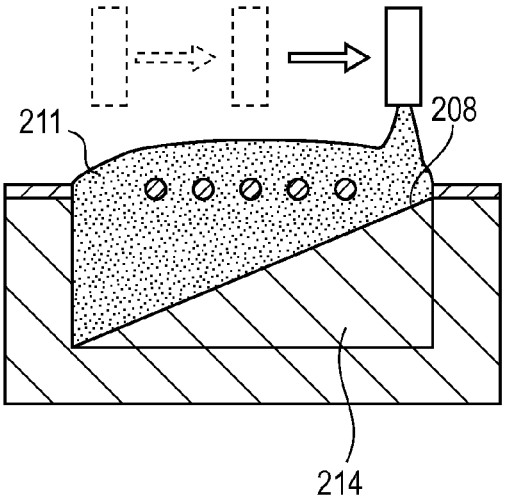

After the sealant is filled to the lower surface of the electrode lead 206 located at the second end, the needle 210 starts moving from the first end toward the second end, as shown in FIG. 2C. When commencing this movement, although the needle 210 starts moving while continuing to apply the sealant so as to shorten the cycle time, the needle 210 may start moving after temporarily stopping the application of the sealant and then start applying the sealant again. The needle 210 is moved in the arrayed direction of the electrode leads 206 at a predetermined rate while the distance between each electrode lead 206 and the needle tip is kept constant. Where necessary, the amount of sealant applied may be gradually increased with the movement of the needle 210 so that the sealant is applied to the upper surface of the electrode leads 206 as smoothly as possible. Applying the sealant up to the lower surface of the electrode leads 206 while setting the needle 210 still for a predetermined period of time and subsequently applying the sealant while moving the needle 210 in this manner may be preferable since the upper surface of the electrode leads 206 can also be reliably covered with the sealant. As a result of the above-described steps, the electrical connection section between the multiple electrode leads 206 and the multiple electrode pads 215 can be reliably covered with the sealant (second application step).

Figure 2D:
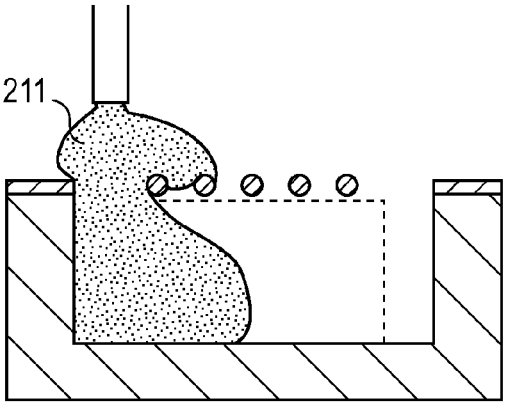

A sealant application process of a comparative example where the inclined portion 214 of the present invention is not provided, as in FIG. 2D, will now be described. In the configuration in FIG. 2D, since the sealant has high viscosity and thus has low fluidity, the sealant overflows in the height direction before reaching the lower surface of the electrode leads distant from the application start position. Even if the needle is moved toward the second end before the sealant overflows in the height direction, it is difficult for the sealant to flow downward through between the multiple electrode leads because the sealant has high viscosity. Therefore, the sealant overflows without being able to seal the space below the electrode leads.

By providing the inclined portion 214 in the seal area so as to gradually decrease the volume below the electrode leads 206 from the application start position toward the application end position of the sealant, as in the present invention, the sealant having high viscosity can be filled below the electrode leads 206. When applying the sealant above the electrode leads 206, since the sealant is already filled to the lower surface of the electrode leads 206 and in-between the electrode leads 206, the sealant at the upper surface of the electrode leads 206 and the sealant at the lower surface of the electrode leads 206 can be integrated without taking in air bubbles due to surface tension.

The inclined surface 208 of the inclined portion 214 may not need to be a smooth slope, as mentioned above, and may alternatively have a stepped shape that gradually increases in height. However, in view of air bubbles possibly taken in when applying the sealant, the steps should be as small as possible and that the inclined surface 208 be a slope without any steps so as to reduce the formation of such air bubbles.

Furthermore, the gap between the sidewalls, facing the side surfaces of the recording element substrate 202, of the inclined portion 214 and the side surfaces of the recording element substrate 202 should be as narrow as possible. When curing the sealant at high temperature (e.g., 100° C. for one hour), the softened sealant is more easily deformable as compared with when the sealant is at room temperature. If the gap between the sidewalls of the inclined portion 214 and the side surfaces of the recording element substrate 202 is wide, the softened sealant tends to deform into a shape that subsides into the gap between the tapered side surfaces and the recording element substrate 202. By narrowing this gap, subsiding deformation of the sealant can be reduced.

Figure 3:
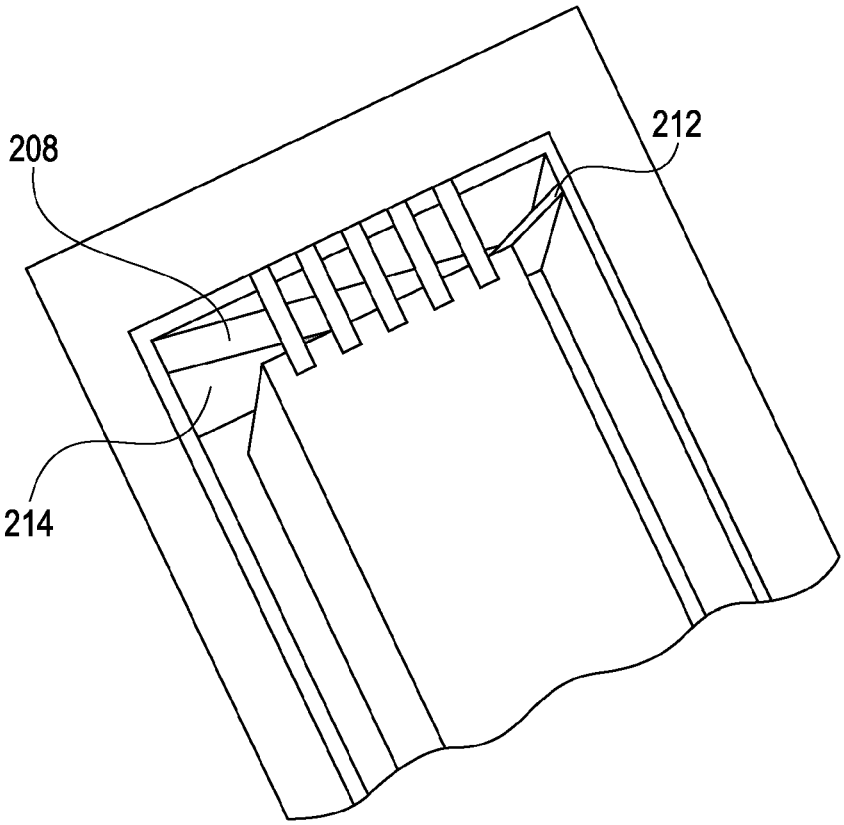
FIG. 3 schematically illustrates a recording element substrate and a surrounding area thereof in the liquid-ejection recording head according to the first embodiment.

As shown in FIG. 3, a wall portion 212 may be formed near the lowest point of the inclined portion 214. This wall portion 212 has a thickness that is smaller than the width of the inclined surface 208 in a direction parallel to the electrode leads 206, and the wall portion 212 is positioned so as to separate the lowest point of the inclined portion 214 from the bottom surface of the recess 209 in the supporting unit 201. By forming this wall portion 212, the sealant filled near the lowest point of the inclined portion 214 is substantially prevented from flowing outside the space below the electrode leads 206.

Figure 4:
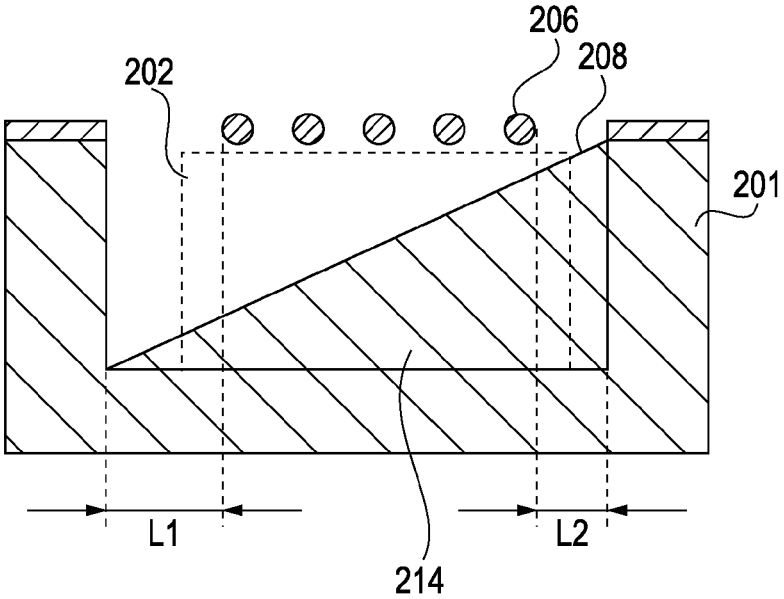
FIG. 4 schematically illustrates the recording element substrate and the surrounding area thereof in the liquid-ejection recording head according to the first embodiment.
Figure 5A:
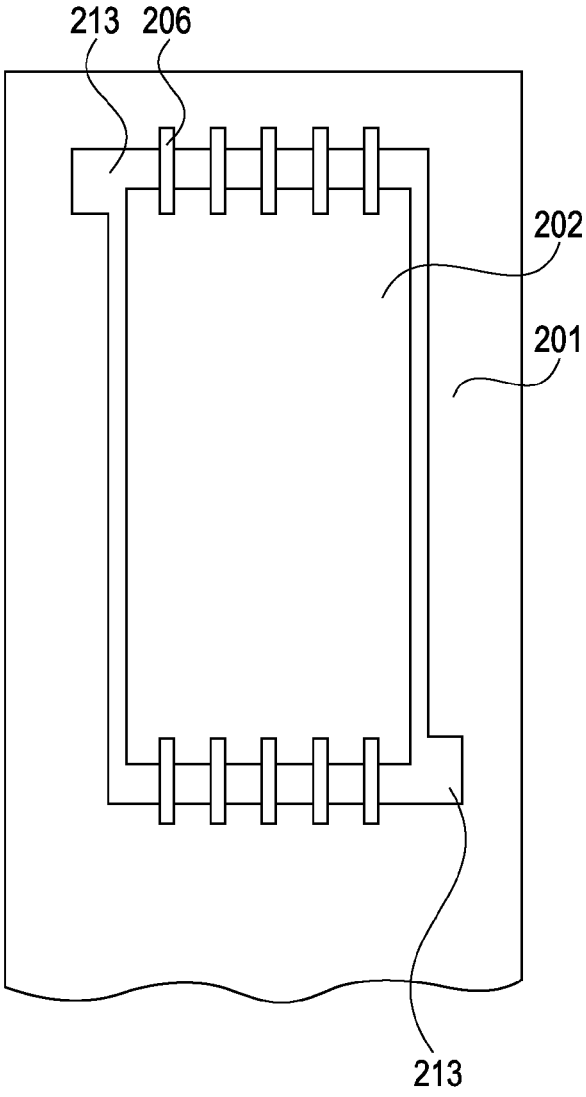
FIGS. 5A and 5B schematically illustrate the recording element substrate and the surrounding area thereof in the liquid-ejection recording head according to the first embodiment.
Figure 5B:
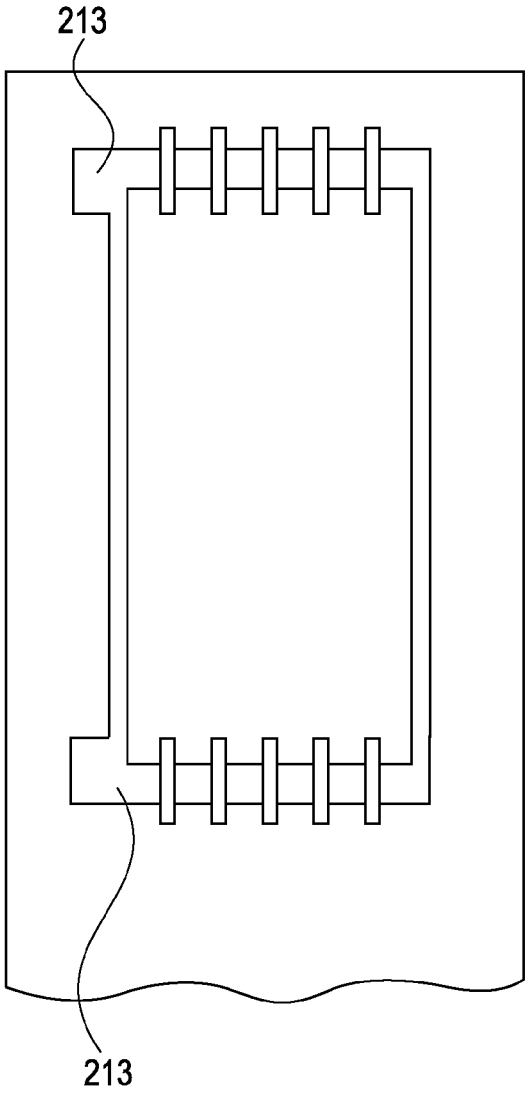

Embodiments for achieving compactness of the recording head H1001 are shown in FIGS. 4 to 5B. In order to fill the space below the electrode leads 206 first with the sealant, a distance L1 between the electrode lead 206 and a wall surface of the supporting unit 201 both near the application start position is to be greater than the diameter of the needle 210 that discharges the sealant, and the diameter of the sealant is to be discharged from the needle 210. On the other hand, since the distance L1 is not necessary at the application end position, the recording element substrate 202 is disposed one-sidedly relative to the wall surfaces of the supporting unit 201, as shown in FIG. 4, so that the relationship L1>L2 is satisfied. This configuration is used in that the width of the liquid-ejection recording head H1001 can be reduced. Furthermore, as shown in FIGS. 5A and 5B, a position at which the needle 210 is set still and applies the sealant is made locally wider than other areas. Thus, the sealant can reliably drop to the seal area at the initial stage of the sealing process, and moreover, the liquid-ejection recording head H1001 can be reduced in size. FIG. 5A illustrates a configuration in which application-start protrusions 213 are provided at diagonal positions relative to the recording element substrate 202. In contrast, FIG. 5B illustrates a configuration in which the application-start protrusions 213 are provided on the same side next to opposing groups of electrode leads 206, respectively.

Figure 6A:
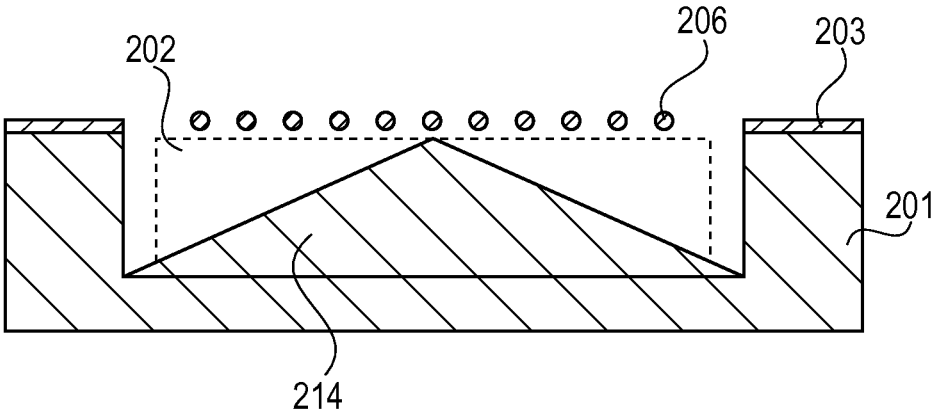
FIGS. 6A and 6B schematically illustrate a recording element substrate and a surrounding area thereof in a liquid-ejection recording head according to a second embodiment.
Figure 6B:
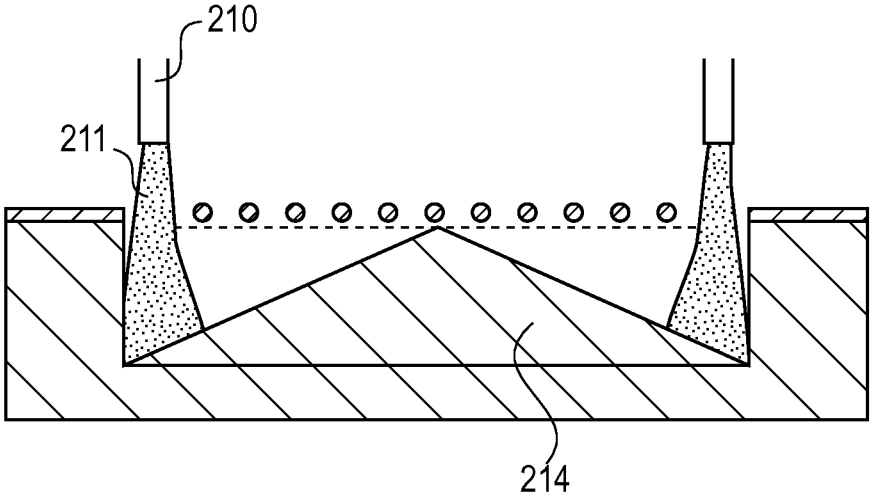

FIGS. 6A and 6B illustrate a second embodiment of the present invention. In the first embodiment, the multiple electrode leads 206 are arranged at two lateral edges of four peripheral edges of the recording element substrate 202. In contrast, in this embodiment, the electrode leads 206 are arranged at two longitudinal edges of the recording element substrate 202. In this case, a configuration similar to that in the first embodiment may be used. However, if the seal area is long, the following embodiment is more suitable.

FIGS. 6A and 6B are cross-sectional views of an area of the electrode leads 206 formed at each of the longitudinal edges of the recording element substrate 202. As shown in these drawings, the inclined portion 214 is formed in a region surrounded by the lower surface of the electrode leads 206, the corresponding longitudinal side surface of the recording element substrate 202, and the supporting unit 201. In this case, the lowest points of the inclined portion 214 are located respectively at the opposite ends of the array of electrode leads 206. The inclined portion 214 gradually increases in height from the lowest points to the center thereof. By preparing a liquid-ejection recording head having such a configuration and performing the sealing process from the lowest points of the inclined portion 214, the electrical connection section can be stably sealed without overflowing of the sealant even when the seal area is long. FIG. 6B illustrates an example of applying the sealant simultaneously from the opposite ends of the array of electrode leads 206. This method may be used since the time consumed for the sealing process can be reduced. Alternatively, the sealing process may be performed individually using a single needle at each end.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-283450 filed Dec. 14, 2009, which is hereby incorporated by reference herein in its entirety.

What is claimed is:

1. A recording head comprising:

a substrate whose first surface is provided with an element that generates energy used for ejecting liquid;

a first portion of a supporting unit that supports a second surface of the substrate, serving as an underside of the first surface of the substrate;

a wiring member having a plurality of electrode leads connected to a plurality of electrode pads provided in the substrate;

a second portion of the supporting unit that supports the wiring member; and a sealant that seals a section including a connection section between the electrode pads and the electrode leads, wherein a region surrounded by the substrate, the second portion of the supporting unit, and the electrode leads is provided with an ascending portion that increases in height in a direction extending from the second surface of the substrate toward the first surface of the substrate, the ascending portion increasing in height from a first end to a second end of the region in an arrayed direction in which the electrode leads are arrayed.

2. The recording head according to claim 1, wherein the ascending portion has a minimum height at the first end of the region and a maximum height at the second end.

3. The recording head according to claim 2, wherein a relationship L1>L2 is satisfied, wherein L1 denotes a distance between one of the arrayed electrode leads that is located adjacent to the first end of the region and a surface of the substrate of the second portion of the supporting unit formed at the first end and extending orthogonally to the arrayed direction, and L2 denotes a distance between one of the arrayed electrode leads that is located adjacent to the second end of the region and a surface of the substrate of the second portion of the supporting unit formed at the second end and extending orthogonally to the arrayed direction.

4. The recording head according to claim 1, wherein the ascending portion increases in height from the first end and the second end of the region toward a center of the region in the arrayed direction.

5. The recording head according to claim 1, wherein a portion with a minimum height in the ascending portion is located outside an end of the arrayed electrode leads in the arrayed direction.

* * * * *